US011486588B2

(12) United States Patent
Ito

(10) Patent No.: US 11,486,588 B2
(45) Date of Patent: Nov. 1, 2022

(54) AIR CONDITIONER

(71) Applicant: Mitsubishi Electric Corporation, Tokyo (JP)

(72) Inventor: Daisuke Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/646,805

(22) PCT Filed: Oct. 20, 2017

(86) PCT No.: PCT/JP2017/038027
§ 371 (c)(1),
(2) Date: Mar. 12, 2020

(87) PCT Pub. No.: WO2019/077744
PCT Pub. Date: Apr. 25, 2019

(65) Prior Publication Data

US 2020/0224891 A1 Jul. 16, 2020

(51) Int. Cl.
*F24F 1/22* (2011.01)
*F24F 1/028* (2019.01)
(Continued)

(52) U.S. Cl.
CPC ..... *F24F 1/022* (2013.01); *F24F 1/028* (2019.02); *F24F 1/029* (2019.02); *F24F 13/222* (2013.01)

(58) Field of Classification Search
CPC ..... F24F 1/029; F24F 13/222; F24F 1/022; F24F 1/028; F24F 3/153; F24F 3/14;
(Continued)

(56) References Cited

U.S. PATENT DOCUMENTS 4,135,370 A * 1/1979 Hosoda ..... F24F 1/037 62/274
5,181,392 A * 1/1993 Itoh ..... F24F 3/153 62/197
(Continued)

FOREIGN PATENT DOCUMENTS

EP 3081871 A1 10/2016
GB 2299656 A * 10/1996 ..... F24F 1/0059
(Continued)

OTHER PUBLICATIONS

Extended European Search Report dated Oct. 15, 2020 in the corresponding EP patent application No. 17928973.1.
(Continued)

*Primary Examiner* — Frantz F Jules
*Assistant Examiner* — Martha Tadesse
(74) *Attorney, Agent, or Firm* — Posz Law Group, PLC

(57) ABSTRACT

An air conditioner includes a casing, and a blower and a refrigerant circuit disposed in the casing. The blower is configured to blow air. The refrigerant circuit has a compressor, a condenser, a decompressor, and an evaporator and is configured to circulate refrigerant in order of the compressor, the condenser, the decompressor, and the evaporator. The condenser has a first heat transfer tube through which the refrigerant flows and which has a first outside diameter. The evaporator has a second heat transfer tube through which the refrigerant flows and which has a second outside diameter. The evaporator is disposed windward of the condenser. The first outside diameter of the first heat transfer tube of the condenser is smaller than the second outside diameter of the second heat transfer tube of the evaporator.

7 Claims, 10 Drawing Sheets

(51) Int. Cl.
*F24F 1/029* (2019.01)
*F24F 13/22* (2006.01)
*F24F 1/022* (2019.01)

(58) Field of Classification Search
CPC ..... F24F 1/02; F28D 1/0435; F28D 7/0066; F28D 1/05316; F28D 7/0083; F28D 7/0091; F25B 2313/0254
See application file for complete search history.

(56) References Cited

U.S. PATENT DOCUMENTS

| | | | | | |
|---|---|---|---|---|---|
| 5,628,125 | A * | 5/1997 | De' Longhi | F24F 1/032 | 62/93 |
| 2007/0012060 | A1* | 1/2007 | Simons | F24F 3/153 | 62/93 |
| 2008/0006039 | A1* | 1/2008 | Kim | F04D 17/06 | 62/93 |
| 2009/0084129 | A1* | 4/2009 | Kim | F28F 13/08 | 62/502 |
| 2015/0013371 | A1* | 1/2015 | Cho | F24F 3/1405 | 62/272 |
| 2016/0018152 | A1* | 1/2016 | Ito | F25D 17/042 | 62/177 |
| 2016/0061475 | A1* | 3/2016 | Ito | F28F 1/126 | 62/271 |
| 2016/0245589 | A1* | 8/2016 | Higashiiue | F28F 21/084 | |
| 2016/0298914 | A1* | 10/2016 | Kanno | B23K 1/00 | |
| 2016/0305672 | A1* | 10/2016 | Jeon | F28F 1/32 | |
| 2018/0296973 | A1 | 10/2018 | Ito et al. | | |

FOREIGN PATENT DOCUMENTS

| | | | | | |
|---|---|---|---|---|---|
| JP | H06-307673 | A | | 11/1994 | |
| JP | 2001090990 | A | * | 4/2001 | F24F 3/153 |
| JP | 2001-221458 | A | | 8/2001 | |
| JP | 2001241749 | A | * | 9/2001 | F24F 3/153 |
| JP | 2003240266 | A | * | 8/2003 | |
| JP | 2008180408 | A | * | 8/2008 | |
| JP | 2009-145009 | A | | 7/2009 | |
| JP | 2010-054060 | A | | 3/2010 | |
| JP | 2015-078399 | A | | 4/2015 | |
| WO | WO-9314353 | A1 | * | 7/1993 | F24F 3/1405 |
| WO | WO-2015059832 | A1 | * | 4/2015 | F24F 1/0059 |
| WO | 2016/056076 | A1 | | 4/2016 | |
| WO | 2017/103987 | A1 | | 6/2017 | |

OTHER PUBLICATIONS

Japanese Office Action dated Mar. 2, 2021, issued in corresponding Japanese Patent Application No. 2019-549083 (and English Machine Translation).
International Search Report of the International Searching Authority dated Dec. 19, 2017 for the corresponding International application No. PCT/JP2017/038027 (and English translation).
Chinese Office Action dated Dec. 3, 2020, issued in corresponding CN Patent Application No. 201780095922.7 (and English Machine Translation).
Office Action dated Jul. 23, 2021, issued in corresponding Chinese Patent Application No. 201780095922.7 (and English Machine Translation).
Office Action dated Dec. 2, 2021, issued in corresponding Chinese Patent Application No. 201780095922.7 (and English machine translation).
Office Action dated Apr. 29, 2022 issued in the counterpart Chinese application 201780095922.7 (and English Translation).
Office action dated Jul. 1, 2022 issued in corresponding European Patent Application No. 17928973.1-1016.

* cited by examiner

AIR CONDITIONER

CROSS REFERENCE TO RELATED APPLICATION

This application is a U.S. national stage application of PCT/JP2017/038027 filed on Oct. 20, 2017, the contents of which are incorporated herein by reference.

TECHNICAL FIELD

The present invention relates to air conditioners.

BACKGROUND ART

An example air conditioner is a dehumidifying apparatus. The dehumidifying apparatus is disclosed in, for example, Japanese Patent Laying-Open No. 2001-221458 (PTL 1). In the dehumidifying apparatus described in PTL 1, an evaporator is disposed windward of a condenser. In a common dehumidifying apparatus, the outside diameter of a heat transfer tube in the evaporator is equal to the outside diameter of a heat transfer tube in the condenser.

CITATION LIST

Patent Literature

PTL 1: Japanese Patent Laying-Open No. 2001-221458

SUMMARY OF INVENTION

Technical Problem

When the outside diameter of the heat transfer tube in the evaporator is equal to the outside diameter of the heat transfer tube in the condenser, the ventilation resistance of a flow path of air that flows around the heat transfer tube in the evaporator is maintained in a flow path of air that flows around the heat transfer tube in the condenser. Thus, the ventilation resistance of the flow path of the air that flows around the heat transfer tube in the condenser may not be smaller than the ventilation resistance of the flow path of air that flows around the heat transfer tube in the evaporator.

The present invention has been made in view of the above problem, and has an object to provide an air conditioner capable of causing the ventilation resistance of a flow path of air that flows around a heat transfer tube in a condenser to be smaller than the ventilation resistance of a flow path of air that flows around a heat transfer tube in an evaporator.

Solution to Problem

An air conditioner according to the present invention includes a casing, and a blower and a refrigerant circuit disposed in the casing. The blower is configured to blow air. The refrigerant circuit has a compressor, a condenser, a decompressor, and an evaporator and is configured to circulate refrigerant in order of the compressor, the condenser, the decompressor, and the evaporator. The condenser has a first heat transfer tube through which the refrigerant flows and which has a first outside diameter. The evaporator has a second heat transfer tube through which the refrigerant flows and which has a second outside diameter. The evaporator is disposed windward of the condenser. The first outside diameter of the first heat transfer tube of the condenser is smaller than the second outside diameter of the second heat transfer tube of the evaporator.

Advantageous Effects of Invention

In the present invention, since the first outside diameter of the first heat transfer tube of the condenser is smaller than the second outside diameter of the second heat transfer tube of the evaporator disposed windward of the condenser, the ventilation resistance of the flow path of air that flows around the first heat transfer tube in the condenser can be made smaller than the ventilation resistance of the flow path of air that flows around the second heat transfer tube in the evaporator.

DESCRIPTION OF EMBODIMENTS

Embodiments of the present invention will now be described in detail with reference to the drawings. The same or corresponding parts are designated by the same references, description of which will not be repeated. Each of the embodiments will describe a dehumidifying apparatus as an example air conditioner.

Embodiment 1

Figure 1:
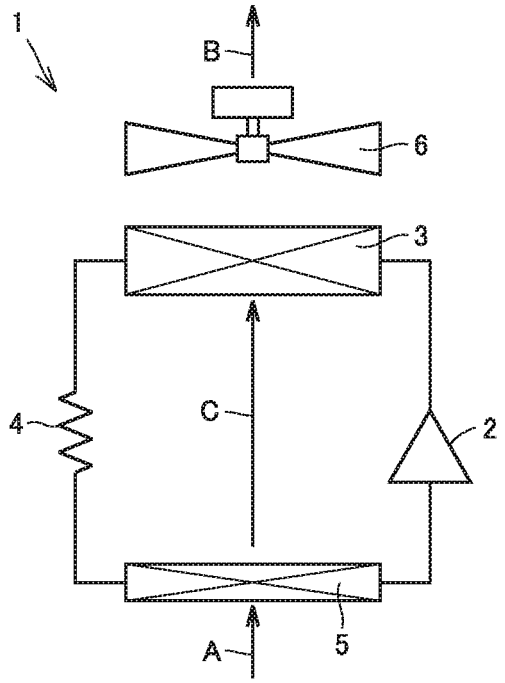
FIG. 1 shows a refrigerant circuit of a dehumidifying apparatus according to Embodiment 1 of the present invention.
Figure 2:
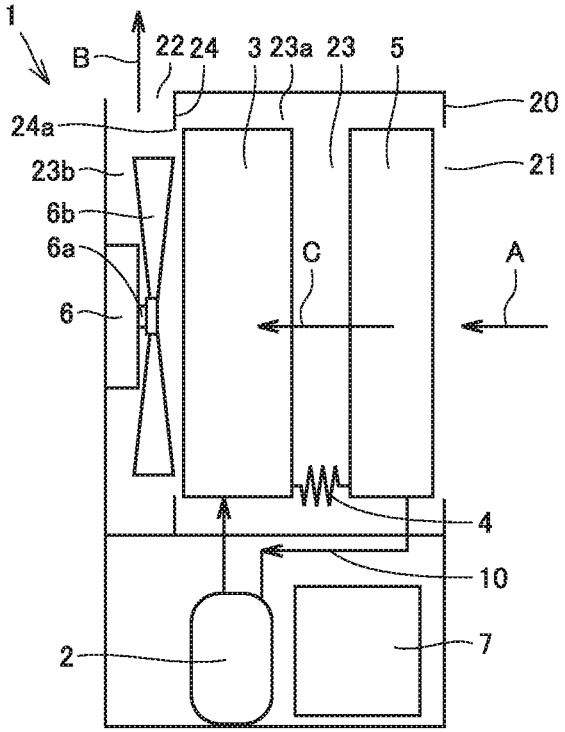
FIG. 2 schematically shows a configuration of the dehumidifying apparatus according to Embodiment 1 of the present invention.

A configuration of a dehumidifying apparatus 1, which is an air conditioner according to Embodiment 1 of the present invention, will be described with reference to FIGS. 1 and 2. FIG. 1 shows a refrigerant circuit of dehumidifying apparatus 1 according to Embodiment 1 of the present invention. FIG. 2 schematically shows a configuration of dehumidifying apparatus 1 according to Embodiment 1 of the present invention.

As shown in FIGS. 1 and 2, dehumidifying apparatus 1 includes a refrigerant circuit 10, which has a compressor 2, a condenser 3, a decompressor 4, and an evaporator 5, a blower 6, and a casing 20. Refrigerant circuit 10 and blower 6 are disposed in casing 20. Casing 20 faces the external space (indoor space) to be dehumidified by dehumidifying apparatus 1.

Refrigerant circuit 10 is configured to circulate refrigerant in order of compressor 2, condenser 3, decompressor 4, and evaporator 5. Specifically, refrigerant circuit 10 is composed of compressor 2, condenser 3, decompressor 4, and evaporator 5 connected in order by a pipe. Refrigerant flows through the pipe and circulates through refrigerant circuit 10 in order of compressor 2, condenser 3, decompressor 4, and evaporator 5.

Compressor 2 is configured to compress refrigerant. Specifically, compressor 2 is configured to suction low-pressure refrigerant through a suction port and compress the refrigerant and then discharge the compressed refrigerant as high-pressure refrigerant through a discharge port. Compressor 2 may be configured to have a variable refrigerant discharge displacement. Specifically, compressor 2 may be an inverter compressor. When compressor 2 is configured to have a variable refrigerant discharge displacement, an amount of the refrigerant circulating through dehumidifying apparatus 1 can be controlled by adjusting the discharge displacement of compressor 2.

Condenser 3 is configured to condense the refrigerant having a pressure increased by compressor 2, thereby cooling the refrigerant. Condenser 3 is a heat exchanger that performs heat exchange between refrigerant and air. Condenser 3 has a refrigerant inlet and a refrigerant outlet, and an air inlet and an air outlet. The refrigerant inlet of condenser 3 is connected to the discharge port of compressor 2 by a pipe.

Decompressor 4 is configured to decompress the refrigerant cooled by condenser 3 to expand the refrigerant. Decompressor 4 is, for example, an expansion valve. This expansion valve may be an electronic control valve. Decompressor 4 is not limited to the expansion valve and may be a capillary tube. Decompressor 4 is connected to each of the refrigerant outlet of condenser 3 and the refrigerant inlet in evaporator 5 by a pipe.

Evaporator 5 is configured to cause the refrigerant expanded by decompression in decompressor 4 to absorb heat, thereby evaporating the refrigerant. Evaporator 5 is a heat exchanger that performs heat exchange between refrigerant and air. Evaporator 5 has a refrigerant inlet and a refrigerant outlet, and an air inlet and an air outlet. The refrigerant outlet of evaporator 5 is connected to the suction port of compressor 2 by a pipe. Evaporator 5 is disposed upstream of condenser 3 in an airflow generated by blower 6. In other words, evaporator 5 is disposed windward of condenser 3.

Blower 6 is configured to blow air. Blower 6 is configured to take in air from the outside to the inside of casing 20 and blow the air to condenser 3 and evaporator 5. Specifically, blower 6 is configured to take in air from the external space (indoor space) into casing 20 and cause the air to flow through evaporator 5 and condenser 3, and then discharge the air to the outside of casing 20.

In the present embodiment, blower 6 has a shaft **6*a* and a fan 6*b* that rotates about shaft 6*a*. As fan 6*b* rotates about shaft 6*a*, the air taken in from the external space (indoor space) as indicated by an arrow A in the figure flows through evaporator 5 and condenser 3 in order, and is then discharged to the external space (indoor space) again as indicated by an arrow B in the figure. In this manner, air circulates through the external space (indoor space) via dehumidifying apparatus 1**.

In the present embodiment, blower 6 is disposed downstream of condenser 3 in the airflow generated by blower 6. Blower 6 may be disposed between condenser 3 and evaporator 5 or upstream of evaporator 5 in the airflow generated by blower 6. For example, one blower 6 may be provided.

Casing 20 is provided with an air inlet 21 for taking in air to the inside of casing 20 from the external space (indoor space) to be dehumidified and an air outlet 22 for blowing out air to the external space (indoor space) from the inside of casing 20. Casing 20 also has an air path (flow path of air) 23 connecting air inlet 21 to air outlet 22. Evaporator 5, condenser 3, and blower 6 are disposed in air path 23. Evaporator 5 and condenser 3 are thus disposed in the same air path 23.

As fan **6*b* rotates about shaft 6*a* in air path 23 as indicated by an arrow C in the figure, air suctioned from the outside of casing 20 through air inlet 21 to the inside of casing 20 flows through evaporator 5, condenser 3, and blower 6 in order, and is then flowed through air outlet 22 to the outside of casing 20**.

In dehumidifying apparatus 1, any member which constitutes the refrigerant circuit together with condenser 3, evaporator 5, and blower 6 may be disposed in air path 23. For example, decompressor 4 may be disposed in air path 23.

Casing 20 also includes a partition 24 that partitions air path 23 into a first region **23*a* and a second region 23*b*. In other words, two regions, first region 23*a* and second region 23*b* partitioned by partition 24, are provided in casing 20. Condenser 3 and evaporator 5 are disposed in first region 23*a*. Blower 6 is disposed in second region 23*b*. First region 23*a* is located windward of second region 23*b* in the airflow generated by blower 6**.

Referring to FIG. 2, partition 24 has a suction port **24*a* of blower 6 which is configured to connect first region 23*a* to second region 23*b*. Partition 24 is formed as a flat plate, for example. When suction port 24*a* is seen from first region 23*a* in the direction (axial direction) in which shaft 6*a* of blower 6 extends, fan 6*b* is disposed in suction port 24*a*. In other words, the outside diameter of fan 6*b* is smaller than the inside diameter of suction port 24*a*. Suction port 24*a* is configured not to block the suction area of fan 6*b***.

When the air conditioner is installed in a room, the room may be cooled by the dissipation of heat of condenser 3 to the outside of the room. For such heat dissipation, an exhaust duct may be mounted on a device on the window side, or the device itself may be installed on the window side.

Figure 3:
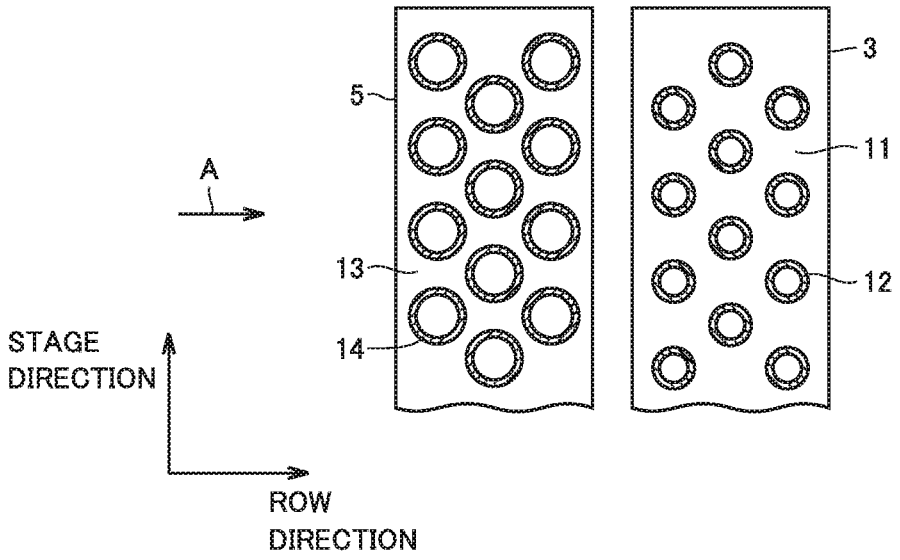
FIG. 3 shows cross-sections of an evaporator and a condenser of the dehumidifying apparatus according to Embodiment 1 of the present invention.

Configurations of condenser 3 and evaporator 5 will now be described in detail with reference to FIG. 3. FIG. 3 shows cross-sections of condenser 3 and evaporator 5 according to Embodiment 1 of the present invention.

In dehumidifying apparatus 1 of the present embodiment, condenser 3 has a plurality of fins 11 and a first heat transfer tube 12. Each of fins 11 is formed as a thin plate. Fins 11 are disposed to be stacked on one another. First heat transfer tube 12 is disposed to pass through fins 11 stacked on one another in a stack direction. First heat transfer tube 12 has a plurality of first linear portions extending linearly in the stack direction and a plurality of first curved portions connecting the plurality of first linear portions. Each of the plurality of first linear portions and a corresponding one of the plurality of first curved portions are connected to each other, resulting in first heat transfer tube 12 configured in a meandering manner. In the present embodiment, first heat transfer tube 12 is a circular tube.

Evaporator 5 has a plurality of fins 13 and a second heat transfer tube 14. Each of fins 13 is formed as a thin plate. Fins 13 are disposed to be stacked on one another. Second heat transfer tube 14 is disposed to pass through fins 13 stacked on one another in a stack direction. Second heat transfer tube 14 has a plurality of second linear portions extending linearly in the stack direction and a plurality of second curved portions connecting the plurality of second linear portions. Each of the plurality of second linear portions and a corresponding one of the plurality of second linear portions are connected to each other in series, resulting in second heat transfer tube 14 configured in a meandering manner. In the present embodiment, second heat transfer tube 14 is a circular tube.

FIG. 3 shows cross-sections of condenser 3 and the evaporator, which are orthogonal to the stack direction of fins 11 of condenser 3 and the stack direction of fins 13 of the evaporator, respectively. In condenser 3, the first linear portions of first heat transfer tube 12 are disposed in the cross-section shown in FIG. 3. The first linear portions of first heat transfer tube 12 have an equal outside diameter (first outside diameter) and an equal inside diameter (first inside diameter).

In the present embodiment, the first linear portions of first heat transfer tube 12 are disposed side by side in three rows in a row direction. The intervals between the first linear portions of first heat transfer tube 12 which are disposed in the respective rows in the row direction may be equal to each other. This interval is a distance between the centers of the first linear portions of first heat transfer tube 12 which are disposed in the respective rows adjacent to each other in the row direction. In the present embodiment, the first linear portions of first heat transfer tube 12 in the respective rows adjacent to each other in the row direction are disposed so as not to be aligned in a stage direction. In other words, the centers of the first linear portions of first heat transfer tube 12 in the respective rows adjacent to each other in the row direction are not disposed linearly in the row direction.

In the present embodiment, also, the first linear portions of first heat transfer tube 12 in the respective rows adjacent to each other in the row direction are disposed so as not to overlap each other in the row direction. In the present embodiment, further, the first linear portions of first heat transfer tube 12 in the respective rows adjacent to each other in the row direction are disposed so as not to partially overlap each other in the stage direction.

In the present embodiment, the first linear portions of first heat transfer tube 12 are disposed side by side in four stages in the stage direction in each row. In the present embodiment, also, the first linear portions of first heat transfer tube 12 are disposed linearly side by side in the stage direction in each row. In other words, the centers of the first linear portions of first heat transfer tube 12 which are disposed side by side in the stage direction in each row are disposed in a line. In the present embodiment, further, the first linear portions of first heat transfer tube 12 which are disposed in the respective rows at the opposite ends in the row direction of the three rows are located at the same position in the stage direction. The positions in the stage direction of the first linear portions of first heat transfer tube 12 which are disposed in the center row in the row direction of the three rows are located at the center between the positions in the stage direction of the first linear portions of first heat transfer tube 12 which are disposed in the respective rows at the opposite ends.

In evaporator 5, the second linear portions of second heat transfer tube 14 are disposed in the cross-section shown in FIG. 3. The second linear portions of second heat transfer tube 14 may have an equal outside diameter (second outside diameter) and an equal inside diameter (second inside diameter).

In the present embodiment, the second linear portions of second heat transfer tube 14 are disposed side by side in three rows in the row direction. The intervals between the second linear portions of second heat transfer tube 14 which are disposed in the respective rows in the row direction of the three rows may be equal to each other. This interval is a distance between the centers of the second linear portions of second heat transfer tube 14 which are disposed in the respective rows adjacent to each other in the row direction. In the present embodiment, the second linear portions of second heat transfer tube 14 in the respective rows adjacent to each other in the row direction are disposed so as not to be aligned in the stage direction. In other words, the centers of the second linear portions of second heat transfer tube 14 in the respective rows adjacent to each other in the row direction are not disposed linearly in the row direction.

In the present embodiment, also, the second linear portions of second heat transfer tube 14 in the respective rows adjacent to each other in the row direction are disposed to partially overlap each other in the row direction. In the present embodiment, further, second heat transfer tubes 14 in the respective rows adjacent to each other in the row direction are disposed to partially overlap each other in the stage direction.

In the present embodiment, the second linear portions of second heat transfer tube 14 are disposed side by side in four stages in the stage direction in each row. In the present embodiment, also, the second linear portions of second heat transfer tube 14 are disposed linearly side by side in the stage direction in each row. In other words, the centers of the second linear portions of second heat transfer tube 14 which are disposed side by side in the stage direction in each row are disposed in a line. In the present embodiment, further, the second linear portions of second heat transfer tube 14 which are disposed in the respective rows at the opposite ends in the row direction of the three rows are located at the same position in the stage direction. The positions in the stage direction of the second linear portions of second heat transfer tube 14 which are disposed in the center row in the row direction of the three rows are located at the center between the positions in the stage direction of the second linear portions of second heat transfer tube 14 which are disposed in the respective rows at the opposite ends.

The first outside diameter of first heat transfer tube 12 of condenser 3 is smaller than the second outside diameter of second heat transfer tube 14 of evaporator 5. The first inside diameter of first heat transfer tube 12 of condenser 3 is smaller than the second inside diameter of second heat transfer tube 14 of evaporator 5. The positions of the centers of the first linear portions of first heat transfer tube 12 which are disposed in the respective rows at the opposite ends in the row direction of three rows in condenser 3 are the same in the stage direction as the positions of the centers of the second linear portions of second heat transfer tube 14 which are disposed in the central row in the row direction of the three rows in evaporator 5. The positions of the centers of first linear portions of first heat transfer tube 12 which are disposed in the central row in the row direction of three rows in condenser 3 are the same in the stage direction as the positions of the centers of the second linear portions of second heat transfer tube 14 which are disposed in the respective rows at the opposite ends in the row direction of three rows in evaporator 5.

The shortest distance between the adjacent first linear portions in first heat transfer tube 12 is greater than the shortest distance between the adjacent second linear portions of second heat transfer tube 14. This shortest distance is the shortest distance between the outer circumferential surfaces of the adjacent heat transfer tubes. The width of the flow path of air that flows around first heat transfer tube 12 is thus greater than the width of the flow path of air that flows around second heat transfer tube 14. For this reason, the ventilation resistance of the flow path of air that flows around first heat transfer tube 12 is smaller than the ventilation resistance of the flow path of air that flows around second heat transfer tube 14.

In FIG. 3, condenser 3 and evaporator 5 are disposed in parallel in the row direction (horizontal direction). Alternatively, condenser 3 and evaporator 5 may be disposed in parallel in the stage direction (vertical direction). For example, even when condenser 3 is located on the upper side and evaporator 5 is located on the lower side, it suffices that evaporator 5 is located on the windward side, condenser 3 is located on the leeward side, and condenser 3 and evaporator 5 are installed in the same air path. First heat transfer tube 12 and second heat transfer tube 14 are not limited to circular tubes, and it suffices that when the tube sectional area of the heat transfer tube through which refrigerant flows is converted into the corresponding sectional area of the circular tube, the corresponding diameter of the heat transfer tube of condenser 3 is smaller than the corresponding diameter of the heat transfer tube of evaporator 5. The corresponding diameter is defined by (4×tube sectional area/π)^0.5.

The operation of dehumidifying apparatus 1 during dehumidification operation will now be described with reference to FIGS. 1 and 2.

Refrigerant in the form of superheated gas discharged from compressor 2 flows into condenser 3 disposed in air path 23. The refrigerant in the form of superheated gas which has flowed into condenser 3 is subjected to heat exchange with air, which has been taken in from the external space into air path 23 through air inlet 21, to be cooled, thereby turning into gas-liquid two-phase state refrigerant. The gas-liquid two-phase state refrigerant is cooled further to turn into supercooled refrigerant.

The refrigerant in the form of supercooled liquid which has flowed from condenser 3 flows through decompressor 4 to be decompressed, turns into gas-liquid two-phase state refrigerant, and then flows into evaporator 5 disposed in air path 23. The gas-liquid two-phase state refrigerant which has flowed into evaporator 5 is subjected to heat exchange with air taken into air path 23 from the external space through air inlet 21 to be heated, turning into refrigerant in the form of superheated gas. The refrigerant in the form of superheated gas is suctioned by compressor 2 and compressed in compressor 2, and is discharged again.

The functions and effects of the present embodiment will now be described.

In dehumidifying apparatus 1 according to the present embodiment, since the first outside diameter of first heat transfer tube 12 of condenser 3 is smaller than the second outside diameter of second heat transfer tube 14 of evaporator 5 disposed windward of condenser 3, the width of the flow path of air in condenser 3 is greater than the width of the flow path of air in evaporator 5. The ventilation resistance of the flow path of air that flows around first heat transfer tube 12 in condenser 3 can thus be smaller than the ventilation resistance of the flow path of air that flows around second heat transfer tube 14 in evaporator 5. Thus, an input of blower 6 (fan input) can be reduced by reducing ventilation resistance. Consequently, dehumidifying apparatus 1 with high energy saving performance can be provided.

Also, since the outside diameter of first heat transfer tube 12 of condenser 3 is smaller than the outside diameter of second heat transfer tube 14 of evaporator 5, the internal capacity of condenser 3 can be made smaller than the internal capacity of evaporator 5. This can reduce a required amount of refrigerant to desired evaporation capability. Further, product cost can be reduced by reducing an amount of refrigerant.

The velocity of flow of liquid refrigerant, heat transfer of which is poor in condenser 3, can be increased by reducing the diameter of first heat transfer tube 12 of condenser 3, thereby improving a heat transfer rate. This can improve the heat exchange performance of condenser 3. Since the velocity of flow of refrigerant can be increased by causing the number of branches of the heat transfer tube in the gas refrigerant region or gas-liquid two-phase refrigerant region to be smaller than the number of branches of the heat transfer tube in the liquid refrigerant region, condensation performance can be improved further. Since a difference between condensation pressure and evaporation pressure in the refrigerant circuit can be reduced by improving condensation performance, a workload of compressor 2 can be reduced. This can reduce power consumption of compressor 2.

Embodiment 2

Dehumidifying apparatus 1 of Embodiment 2 of the present invention differs from dehumidifying apparatus 1 of Embodiment 1 in that a material having a pitting potential higher than that of evaporator 5 is used for condenser 3. In dehumidifying apparatus 1 of the present embodiment, the material for condenser 3 has a pitting potential higher than the pitting potential of the material for evaporator 5.

Commonly, a material having a lower pitting potential is more prone to corrosion. At a pitting potential of the material for condenser 3 which is higher than the pitting potential of the material for evaporator 5, the corrosion of condenser 3 is reduced when water (dehumidification water) generated after dehumidification by evaporator 5 is scattered to condenser 3.

At a pitting potential of the material for condenser 3 which is lower than the pitting potential of the material for evaporator 5, the corrosion of the material for condenser 3 is more likely to progress when the dehumidification water containing the material for evaporator 5 is scattered to the condenser or when evaporator 5 and condenser 3 contact each other.

During operation of dehumidifying apparatus 1, condenser 3 has a pressure higher than that of evaporator 5. Condenser 3 is thus more prone to breakage than evaporator 5 as the corrosion, particularly pitting progresses, leading to a higher risk of leakage of refrigerant from condenser 3. For example, when the materials for evaporator 5 and condenser 3 are aluminum, a preferable combination of materials is an aluminum alloy 1050 (pitting potential of −745.8 mV) for evaporator 5 and an aluminum alloy 3003 (pitting potential of −719.3 mV) for condenser 3.

Since the risk of leakage of refrigerant does not increase even when fin 13 of condenser 3 corrodes, it suffices that the pitting potential of the material for first heat transfer tube 12 of condenser 3 is higher than the pitting potential of the material for second heat transfer tube 14 of evaporator 5. The effect of preventing leakage of refrigerant due to corrosion of the heat transfer tube is enhanced by setting pitting potentials such that the fin of the evaporator≤the fin of the condenser<the heat transfer tube of the evaporator<the heat transfer tube of the condenser.

In the air conditioner according to the present embodiment, the pitting potential of the material for condenser 3 is higher than the pitting potential of the material for evaporator 5. Thus, even when the water generated after dehumidification by evaporator 5 is scattered to condenser 3, the corrosion of condenser 3 can be reduced because condenser 3 is more resistant to corrosion than evaporator 5.

Embodiment 3

Figure 4:
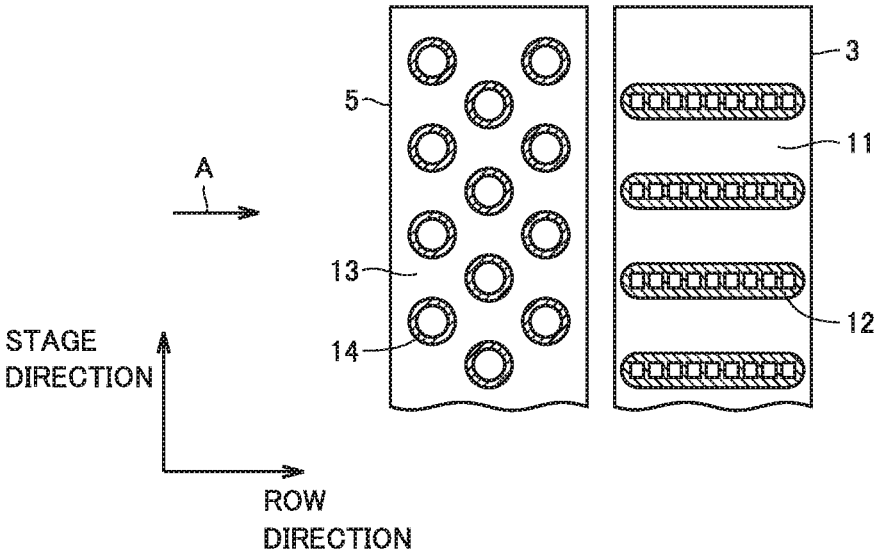
FIG. 4 shows cross-sections of an evaporator and a condenser of a dehumidifying apparatus according to Embodiment 3 of the present invention.

Referring to FIG. 4, dehumidifying apparatus 1 of Embodiment 3 of the present invention differs from dehumidifying apparatus 1 of Embodiment 1 in first heat transfer tube 12 of condenser 3. FIG. 4 shows cross-sections of condenser 3 and the evaporator, which are orthogonal to the stack direction of fins 11 of condenser 3 and the stack direction of fins 13 of the evaporator, respectively.

Second heat transfer tube 14 of evaporator 5 is a circular tube. First heat transfer tube 12 of condenser 3 is a flat tube. First heat transfer tube 12 has a cross-section that extends in the direction in which evaporator 5 and condenser 3 are aligned. First heat transfer tube 12 has a plurality of first linear portions extending linearly in the stack direction and a header connecting the plurality of first linear portions. Each of the plurality of first linear portions of first heat transfer tube 12 has a plurality of small-diameter pipe paths.

In dehumidifying apparatus 1 according to the present embodiment, a circular tube having excellent drainage performance is used as second heat transfer tube 14 of evaporator 5, and a flat tube which has a small inside diameter and has a flat shape in its entirety is used as first heat transfer tube 12 of condenser 3. This can lead to a small ventilation resistance of condenser 3.

In evaporator 5 of dehumidifying apparatus 1, any dehumidification water accumulated in fin 13 or second heat transfer tube 14 may inhibit heat transfer between air and refrigerant or deteriorate a ventilation resistance. Particularly in dehumidifying apparatus 1 installed in a room, leakage of dehumidification water into the room may be caused. A heat exchanger having a combination of a plate fin and a circular tube has excellent drainage performance compared with a heat exchanger including a flat tube or the like, and accordingly can restrain a decrease in heat exchange performance due to the accumulation of dehumidification water, because dehumidification water is drained along the plate fin from the opposite sides in the radial direction of the circular tube. On the other hand, the use of a heat exchanger including a flat tube in condenser 3 can reduce the internal capacity of condenser 3 owing to decreased diameter and can also reduce a ventilation resistance owing to a flat shape.

Although the internal capacity can be reduced by using a plurality of small-diameter circular tubes, a large number of small-diameter circular tubes are needed to compensate for heat exchange performance (tube outer area), leading to increases in ventilation resistance and cost. Since a flat tube with many holes has a plurality of flow paths integrated into one, the flat tube can be fewer than small-diameter tubes. Thus, fan input can be reduced owing to a decreased ventilation resistance, and condenser 3 can be made inexpensively.

A flat tube may be disposed horizontally or vertically. The shape of the fin of condenser 3, such as plate fin or corrugated fin, is selected depending on desired performance, the installation position of a flat tube, or the like. Thus, dehumidifying apparatus 1 which has excellent energy saving performance and is inexpensive can be provided.

Embodiment 4

Figure 5:
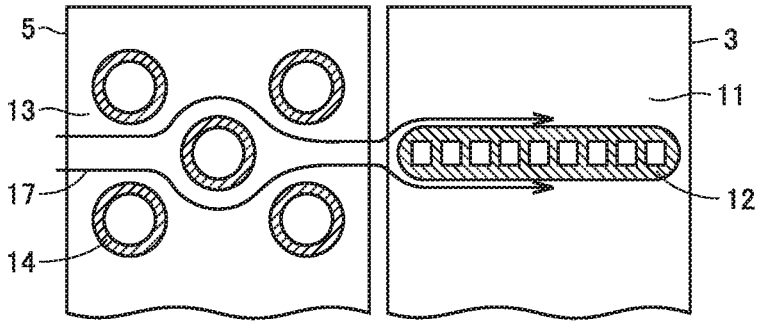
FIG. 5 shows cross-sections of an evaporator and a condenser of a dehumidifying apparatus according to Embodiment 4 of the present invention.
Figure 6:
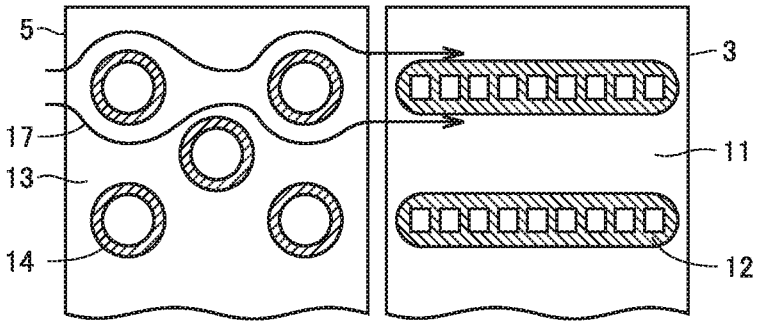
FIG. 6 shows cross-sections of an evaporator and a condenser of a dehumidifying apparatus according to a comparative example of Embodiment 4 of the present invention.

Referring to FIG. 5, dehumidifying apparatus 1 of Embodiment 4 of the present invention differs from dehumidifying apparatus 1 of Embodiment 1 in first heat transfer tube 12 of condenser 3. FIGS. 5 and 6 each show cross-sections of condenser 3 and the evaporator, which are orthogonal to the stack direction of fins 11 and the stack direction of fins 13, respectively.

As indicated by the arrows in FIG. 5, first heat transfer tube 12 of condenser 3 is disposed in a region which is less occupied by second heat transfer tube 14 of evaporator 5 in the ventilation direction. First heat transfer tube 12 of condenser 3 is disposed in a region which is less occupied by second heat transfer tube 14 of evaporator 5 in the direction in which evaporator 5 and condenser 3 are aligned.

As shown in FIG. 5, since first heat transfer tube 12 of condenser 3 is disposed in the region which is less occupied by second heat transfer tube 14 of evaporator 5 in the ventilation direction (row direction), the ventilation resistance in the ventilation direction can be made uniform in the stage direction. This can make the wind velocity distribution of air which enters evaporator 5 on the most upstream side uniform, leading to high heat exchange efficiency.

Since wind velocity increases partially when a drift occurs in the air of evaporator 5, the ventilation resistance deteriorates, leading to deteriorated fan input. Since the average wind velocity on the front surface of the evaporator decreases when the wind velocity is uniform, fan input can be reduced.

As shown in FIG. 6, first heat transfer tube 12 of condenser 3 is disposed in the region which is more occupied by second heat transfer tube 14 of evaporator 5 in the direction in which evaporator 5 and condenser 3 are aligned. In this case, the tailing edge of second heat transfer tube 14 of evaporator 5 is a dead water region with a small heat exchange amount, leading to deteriorated heat exchange efficiency at the leading edge of first heat transfer tube 12 of condenser 3.

Contrastingly, in dehumidifying apparatus 1 according to the present embodiment, first heat transfer tube 12 of condenser 3 is disposed in a region which is less occupied by second heat transfer tube 14 of evaporator 5, as shown in FIG. 5. Thus, air passes through first heat transfer tube 12 of condenser 3 with the tailing edge of the second heat transfer tube of evaporator 5 having little effect. This enables heat transfer at the leading edge of first heat transfer tube 12 of condenser 3, leading to increased heat exchange efficiency.

Embodiment 5

In dehumidifying apparatus 1 of Embodiment 5 of the present invention, refrigerant may be a hydrocarbon (HC)-based flammable refrigerant. Specifically, refrigerant may be R290 or the like. The capacity of condenser 3 to the capacity of evaporator 5 is 100% or less.

Figure 7:
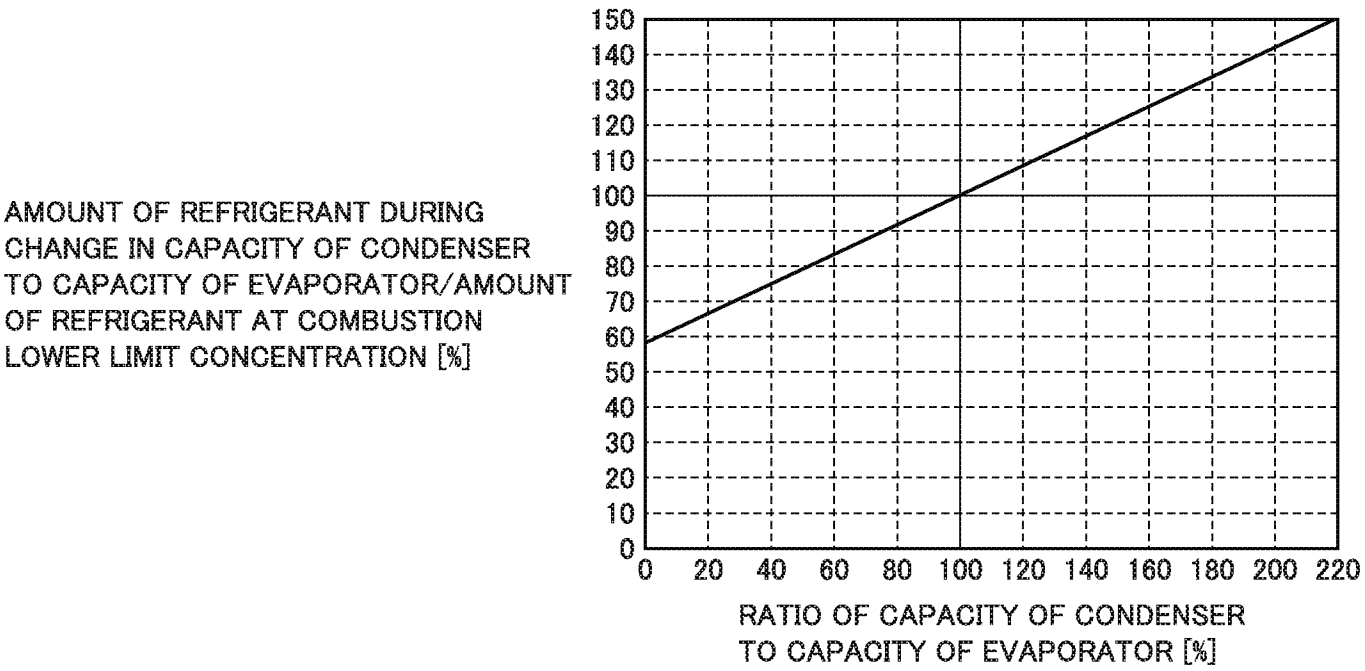
FIG. 7 is a graph showing a relationship between a ratio of a capacity of a condenser to a capacity of an evaporator and an amount of refrigerant during change in the capacity of the condenser to a capacity of the evaporator/an amount of refrigerant at a combustion lower limit concentration in a dehumidifying apparatus according to Embodiment 5 of the present invention.

Referring to FIG. 7, refrigerant will be described by taking R290, which is a hydrocarbon (HC)-based flammable refrigerant, as an example. FIG. 7 shows a relationship between a ratio of the capacity of a condenser to the capacity of evaporator 5 which represents a capacity of a flow path of refrigerant and an amount of refrigerant during change in the capacity of condenser 3 to the capacity of the evaporator/an amount of refrigerant at a combustion lower limit concentration. At the horizontal axis in FIG. 7, the ratio of the capacity of the condenser to the capacity of the evaporator is 100% when the capacity of the evaporator is equal to the capacity of the condenser. At the vertical axis in FIG. 7, an amount of refrigerant during change in the capacity of a condenser to the capacity of an evaporator/an amount of refrigerant at a combustion lower limit concentration is 100% when an amount of refrigerant at the combustion lower limit concentration is equal to an amount of refrigerant during change in the capacity of a condenser to the capacity of an evaporator. A ratio less than 100% results in an amount of refrigerant which is nonflammable.

In an existing heat exchanger including a plate-fin-type circular tube, the ratio of the capacity of a condenser to the capacity of an evaporator is 200% or more, which exceeds the ratio at the combustion lower limit concentration. Dehumidifying apparatus 1 that can be used at an amount of refrigerant less than an amount at the combustion lower limit concentration of R290 can be provided by using a small-diameter circular tube, a flat tube, or the like as the heat transfer tube of condenser 3 to set the capacity of condenser 3 to 100% or less with respect to the capacity of evaporator 5. Since the size of a room for installation is larger as capability increases, when the ratio of the capacity of a condenser to the capacity of an evaporator is 100% or less, a concentration less than the concentration at the combustion lower limit can be maintained irrespective of capability range. The combustion lower limit concentration of R290 is 2%, and in the present embodiment, dehumidifying apparatus 1 can be configured with a refrigerant amount of less than 2% to the indoor capacity.

Although description has been given of refrigerant by taking R290 as an example, the present invention is not limited thereto. Although a difference in liquid concentration due to a difference in another hydrocarbon (HC)-based refrigerant, such as R600a, is small, the capacity of condenser 3 may be adjusted in accordance with desired refrigerant.

Embodiment 6

Figure 8:
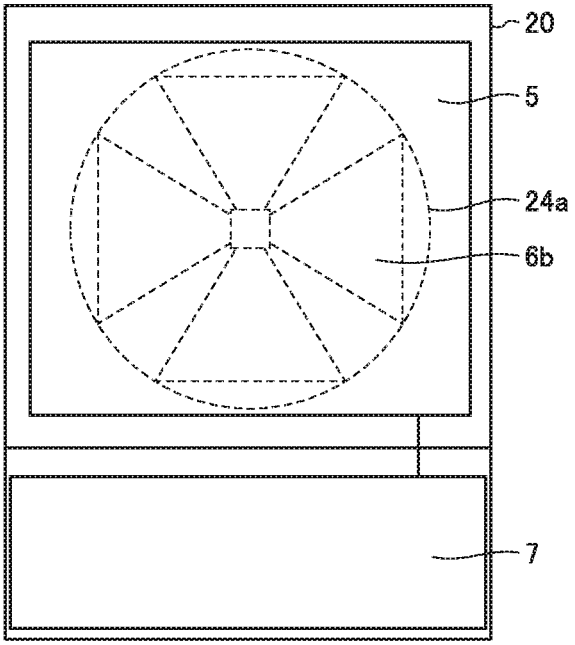
FIG. 8 shows a positional relationship between an evaporator and a suction port of a blower of a dehumidifying apparatus according to Embodiment 6 of the present invention.

FIG. 8 shows a positional relationship between evaporator 5 and suction port 24*a* when evaporator 5 is seen from the side opposite to suction port 24*a* in the direction in which evaporator 5 and suction port 24*a* overlap each other. Referring to FIG. 8, in dehumidifying apparatus 1 of Embodiment 6 of the present invention, a heat exchange area by fins and a heat transfer tube is larger than an area formed by suction port 24*a* of blower 6. In other words, the area of each of condenser 3 and evaporator 5 is larger than the area of suction port 24*a* of blower 6.

In dehumidifying apparatus 1 according to the present embodiment, since the area of each of condenser 3 and evaporator 5 is larger than the area of suction port 24*a* of blower 6, the wind velocity of air that flows into condenser 3 and evaporator 5 can be made smaller than when the area of each of condenser 3 and evaporator 5 is smaller than the area of suction port 24*a* of blower 6. This can reduce a ventilation resistance, leading to a reduction in fan input.

Embodiment 7

Figure 9:
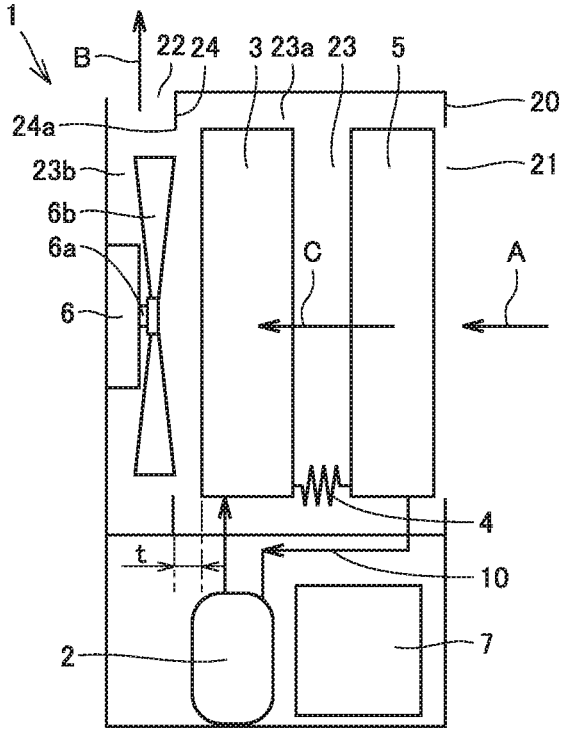
FIG. 9 schematically shows a configuration of a dehumidifying apparatus according to Embodiment 7 of the present invention.

Referring to FIG. 9, a desired clearance t is provided between condenser 3 and suction port 24*a* of blower 6 in dehumidifying apparatus 1 of Embodiment 7 of the present invention.

According to the present embodiment, since clearance t is provided between condenser 3 and suction port 24*a* of blower 6, air that flows through condenser 3 and evaporator 5 can be collected in a wide range beyond the area of suction port 24*a* of blower 6 compared with the case where no clearance t is provided, thus extending an effective heat exchange area of the heat exchanger. This improves heat exchange performance, so that dehumidifying apparatus 1 having excellent power saving performance can be provided through improvements in evaporation performance and condensation performance.

Embodiment 8

Figure 10:
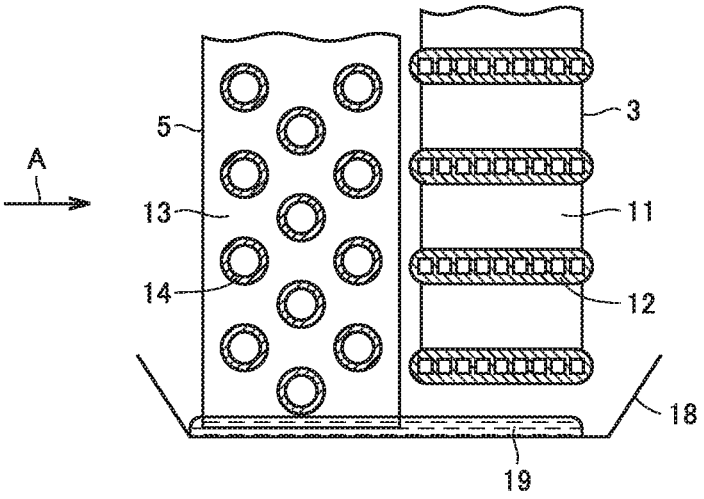
FIG. 10 shows cross-sections of an evaporator and a condenser of a dehumidifying apparatus according to Embodiment 8 of the present invention.

Referring to FIG. 10, dehumidifying apparatus 1 of Embodiment 8 of the present invention includes a drain pan 18 disposed below condenser 3. Drain pan 18 is configured to store dehumidification water (drain water). A clearance is provided between condenser 3 and drain pan 18. In other words, the bottom surface of condenser 3 and the upper surface of drain pan 18 are vertically apart from each other. In the present embodiment, also, fin 11 is provided between adjacent first heat transfer tube 12. Fin 11 may be a corrugated fin. The clearance between fin 11 or first heat transfer tube 12 and drain pan 18 may be provided with a header (not shown) as a pillar.

In dehumidifying apparatus 1 of the present embodiment, a clearance is provided between condenser 3 and drain pan 18. This can reduce pitting of fins 11 and first heat transfer tubes 12 of condenser 3 due to a potential difference between evaporator 5 and condenser 3 through dehumidification water.

When a common heat exchanger of plate fin type is used, dehumidification water 19 is held by fin 11 at the lower end of condenser 3. Consequently, dehumidification water 19 flows to a drain tank less easily, which may lead to leakage of dehumidification water 19.

In dehumidifying apparatus 1 of the present embodiment, a clearance is provided such that fin 11 or first heat transfer tube 12 of condenser 3 does not contact drain pan 18. This restrains fin 11 at the lower end of condenser 3 from holding dehumidification water 19. This restrains dehumidification water 19 from flowing to the drain tank (not shown) less easily, thus reducing leakage of dehumidification water 19.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1 dehumidifying apparatus, 2 compressor, 3 condenser, 4 decompressor, 5 evaporator, 6 blower, 10 refrigerant circuit, 12 first heat transfer tube, 14 second heat transfer tube, 18 drain pan, 20 casing, 24*a* suction port, t clearance.

The invention claimed is:

1. An air conditioner comprising:

a casing; and a blower and a refrigerant circuit disposed in the casing, wherein the blower is configured to blow air, the refrigerant circuit has a compressor, a condenser, a decompressor, and an evaporator and is configured to circulate refrigerant in order, through the compressor, the condenser, the decompressor, and the evaporator, the condenser has a plurality of first fins stacked on one another in a stack direction and a first heat transfer tube that passes through the plurality of first fins and through which the refrigerant flows, the evaporator has a plurality of second fins stacked on one another in the stack direction and a second heat transfer tube through which the refrigerant flows, the evaporator is disposed upstream of the condenser with respect to an airflow generated by the blower, the second heat transfer tube of the evaporator is a tube which is circular in cross section, and the first heat transfer tube of the condenser is a flat tube, the first heat transfer tube includes a plurality of first linear portions extending linearly in the stack direction and a plurality of first curved portions connecting the plurality of first linear portions respectively, the second heat transfer tube has a plurality of second linear portions extending linearly in the stack direction and a plurality of second curved portions connecting the plurality of second linear portions in series, a shortest distance between an outer circumferential surface of the first linear portions which are adjacent to each other in a vertical direction is greater than a shortest distance between an outer surface of the second linear portions which are adjacent to each other in the vertical direction, and the stack direction of the first fins of the condenser and the stack direction of the second fins of the evaporator are aligned in a parallel manner.

2. The air conditioner according to claim 1, wherein a material of the condenser has a pitting potential higher than a pitting potential of a material for the evaporator.

3. The air conditioner according to claim 1, wherein in the vertical direction the evaporator alternates rows having more of the second linear portions and having fewer of the second linear portions, and the evaporator and the condenser are aligned so that the first linear portions of the condenser are aligned with the rows having fewer of the second linear portions of the evaporator in a direction in which the evaporator and the condenser are aligned.

4. The air conditioner according to claim 1, wherein the refrigerant is a hydrocarbon-based flammable refrigerant, and a ratio of a capacity of the condenser to a capacity of the evaporator is 100% or less.

5. The air conditioner according to claim 1, wherein each of the condenser and the evaporator has a heat exchange area larger than a heat exchange area of a suction port of the blower.

6. The air conditioner according to claim 5, wherein a clearance is provided between the condenser and the suction port of the blower.

7. The air conditioner according to claim 1, comprising a drain pan disposed below the condenser, wherein a clearance is provided between the condenser and the drain pan.

* * * * *